United States Patent [19]

Ostergren

[11] Patent Number: 4,702,476

[45] Date of Patent: Oct. 27, 1987

[54] GAME SET OF DYADIC ARTICLES

[76] Inventor: Raymond R. Ostergren, 6300 W. Touhy Ave., Niles, Ill. 60648

[21] Appl. No.: 766,025

[22] Filed: Aug. 15, 1985

[51] Int. Cl.[4] ..... A63F 9/00

[52] U.S. Cl. ..... 273/1 E; 273/289; 434/259; 446/485; 446/123

[58] Field of Search ..... 273/237, 1 E, 238, 276, 273/288, 289, 290, 260; 434/259, 104; 446/69, 123, 175, 485

[56] References Cited

U.S. PATENT DOCUMENTS

| | | | |
|---|---|---|---|
| 2,054,516 | 9/1936 | Mabey | 273/139 |
| 2,066,469 | 1/1937 | Haas | 273/139 |
| 2,120,172 | 6/1938 | Burnett et al. | 273/139 |
| 2,416,959 | 3/1947 | Segal . | |
| 2,766,988 | 10/1956 | Haumersen | 273/135 |
| 2,889,634 | 6/1959 | Bringmann . | |
| 3,389,913 | 6/1968 | Tunstall | 273/237 |
| 3,661,393 | 5/1972 | Skebeck . | |
| 3,710,455 | 1/1973 | Liversidge et al. . | |
| 3,809,409 | 5/1974 | Haradyn | 273/139 |
| 3,856,309 | 12/1974 | Helfgott | 273/288 |
| 3,984,109 | 10/1976 | Wiles | 273/288 |
| 4,159,117 | 6/1979 | Kuna | 273/288 |
| 4,176,470 | 12/1979 | Fosner et al. . | |
| 4,338,742 | 7/1982 | Outtrim et al. | 446/485 |
| 4,343,476 | 8/1982 | Engel et al. | 273/289 |
| 4,348,191 | 9/1982 | Lipsitz et al. | 434/308 |
| 4,385,762 | 5/1983 | Schwartz | 434/259 |

FOREIGN PATENT DOCUMENTS

| | | | |
|---|---|---|---|
| 1275329 | 9/1961 | France | 446/69 |
| 1109819 | 4/1968 | United Kingdom . | |

*Primary Examiner*—Richard C. Pinkham
*Assistant Examiner*—MaryAnn Stoll Lastova
*Attorney, Agent, or Firm*—Gerlach & O'Brien

[57] ABSTRACT

A game set includes a plurality of individual game articles, with each article including two companion playing pieces. The pieces mate with each other, but not with the pieces of other articles in the set, to form the article. The pieces of each article are separable from each other, for playing a game of seeking to mate the companion pieces of the article. In a preferred embodiment, a signal device is included in each article and is actuated by assembling the playing pieces into the article.

9 Claims, 11 Drawing Figures

36
36a
112
114
22
118
121
116
120
54
58
20
24
76
60
28
40
48
52
46
56
62
66
72
64
74
70
108
94
90
92
96
79
81
82
80
34
34a
78
85
86
83
84
38
26
192
191
98
190
194
96
204
188
206
128a
186
128
184
212
182
142
152
187
142a
140a
150
146
144
210
140
208
134
148
140b
176
158
145
178
213
196
197
136
162
164
137
177
166
138
178
125
124
129
132
130

FIG. 4
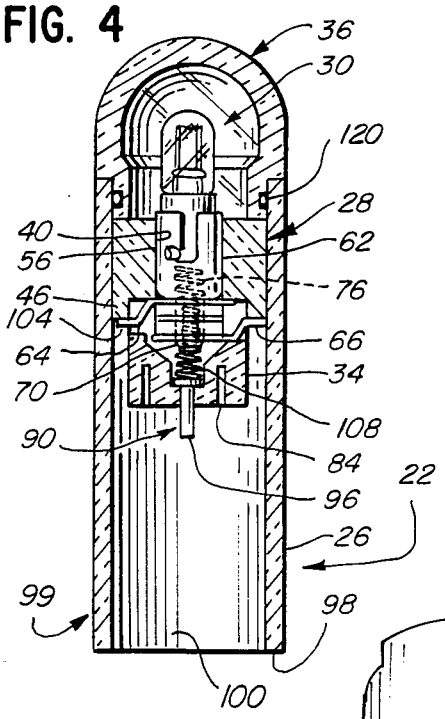
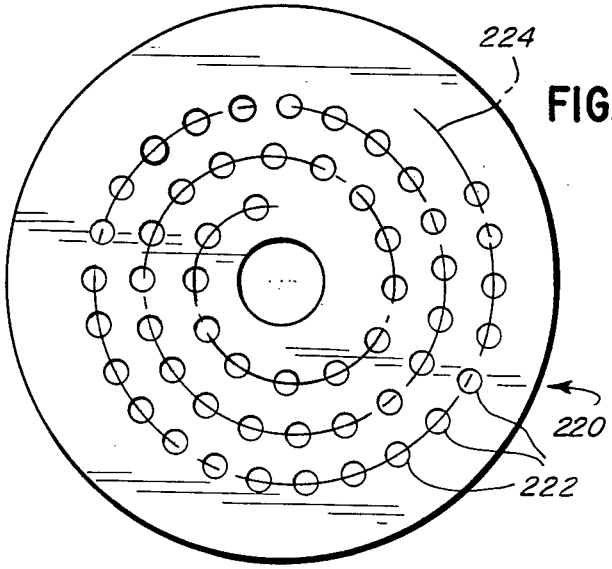
FIG. 8
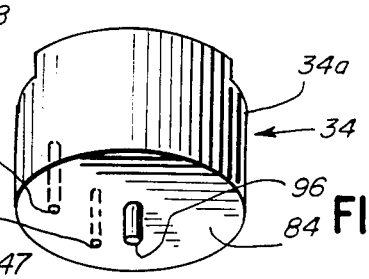
FIG. 6
FIG. 9
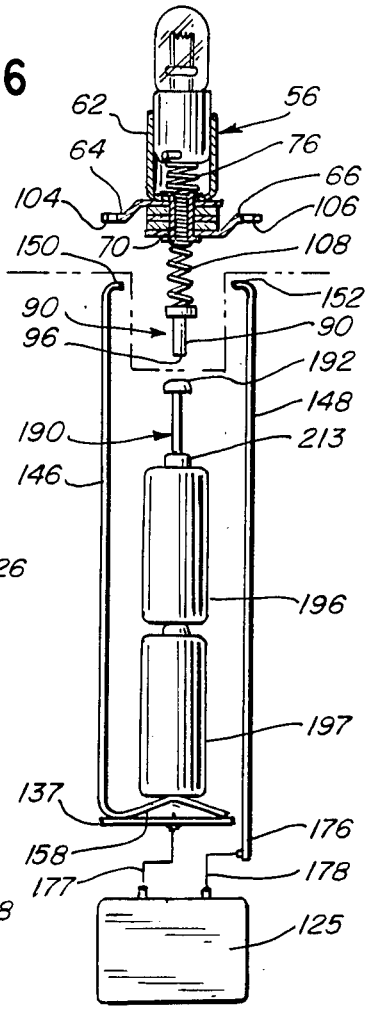
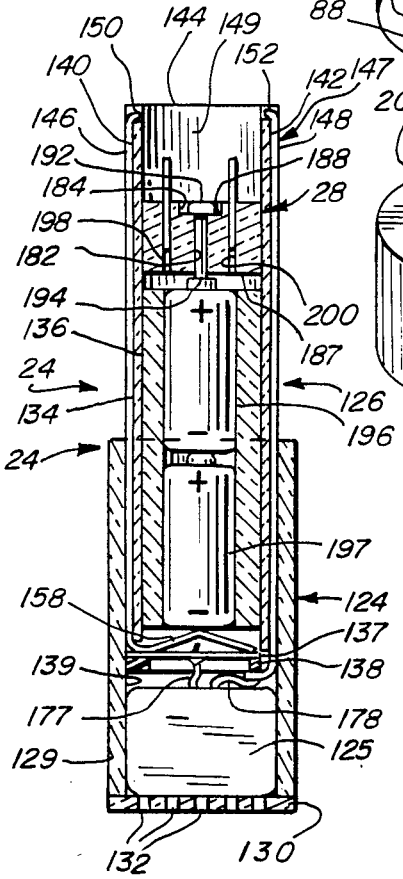
FIG. 5
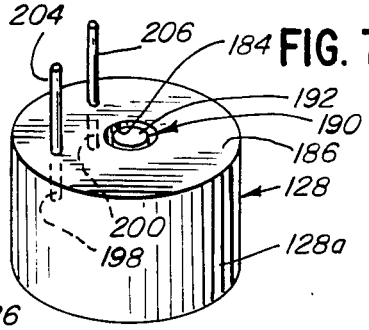
FIG. 7
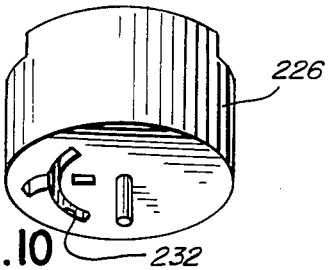
FIG. 10
FIG. 11
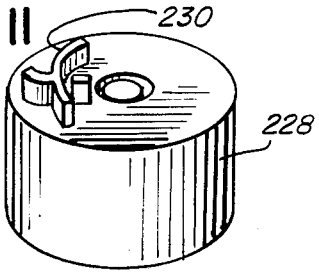

GAME SET OF DYADIC ARTICLES

BACKGROUND OF THE INVENTION

This invention relates to games, particularly to a game set for promotng social interaction in a group of players. More particularly, the invention relates to a game set of individual dyadic game articles each formed of mating playing pieces that are to be matched up by the players in playing a game, and to a game article for use as part of the game set.

SUMMARY OF THE INVENTION

An object of the present invention is to provide a set of articles for a game that may be played simultaneously by a group of players of any number, to promote lively interaction among all of the members of the group while individual members make social contact with a number of persons each time the game is played.

A more particular object is to provide a game set for a game in which each person is given or selects one piece of a two-piece game article, by an appropriate method of random selection of the pieces, and each person then seeks to locate a person having a piece that matches his piece, by a trial-and-error process of matching pieces.

An additional object is to provide a game set for a game in which the achievement of a matched pair of pieces, to form an assembled article, is signalled to the participants, so as to enliven the activities and add to the excitement of playing the game.

A further object is to provide a game set for a game of the foregoing character, which is readily understood and in which the game articles are conveniently sized, compact, and self-contained, for playing the game by any individuals and at virtually any place a group may gather, without need for any special facilities or equipment, or for a separate supply of energy.

Another object is to provide a game article that is well-adapted for use in a set of articles, for playing a game of the foregoing character.

In its preferred embodiments, the game set of the present invention includes a plurality of individual game articles, with each article including two companion playing pieces. The pieces of each article include means on respective pieces mating with each other, but being non-matable with mating means on the pieces of other articles in the set, to form the article. The pieces of each article are separable from each other, for playing a game of seeking to mate the mating means of one piece with the mating means of a companion piece.

In further preferred embodiments of the invention, signal means are included in each article and are actuated by assembling the playing pieces into the article.

BRIEF DESCRIPTION OF THE DRAWINGS

The drawings illustrate preferred embodiments of the invention, without limitation thereto. In the drawings, like elements are identified by like reference symbols in each of the views, and:

FIG 4 is an elevational and partly longitudinal sectional view of a female playing piece of the article of FIG. 1, with parts broken away for clarity;

FIG. 5 is an elevational and partly longitudinal sectional view of a male playing piece of the article of FIG. 1;

FIG. 6 is a further enlarged perspective view of an interfit unit of the female playing piece of FIG. 4, showing a contact member, and recesses for mating with a complementary unit of the male playing piece of FIG. 5;

FIG. 7 is a similarly enlarged perspective view of an interfit unit of the male playing piece of FIG. 5, complementary to the unit of FIG. 6, showing a second contact member, and pegs received in the recesses of the unit of FIG. 6;

FIG. 8 is a diagrammatic representation of a jig, enlarged with respect to FIGS. 6 and 7 which may be used to position the complementary recesses and pegs of the units illustrated in such views;

FIG. 9 is a schematic representation of the electrical circuits in the game article of FIG. 1; and FIGS. 10 and 11 are perspective views of interfit units which may be employed in place of the units of FIGS. 6 and 7, respectively, in female and male playing pieces otherwise like the respective piece of FIGS. 4 and 5, in another embodiment of the game article.

DESCRIPTION OF THE PREFERRED EMBODIMENTS

Figures 1, 2, 3:
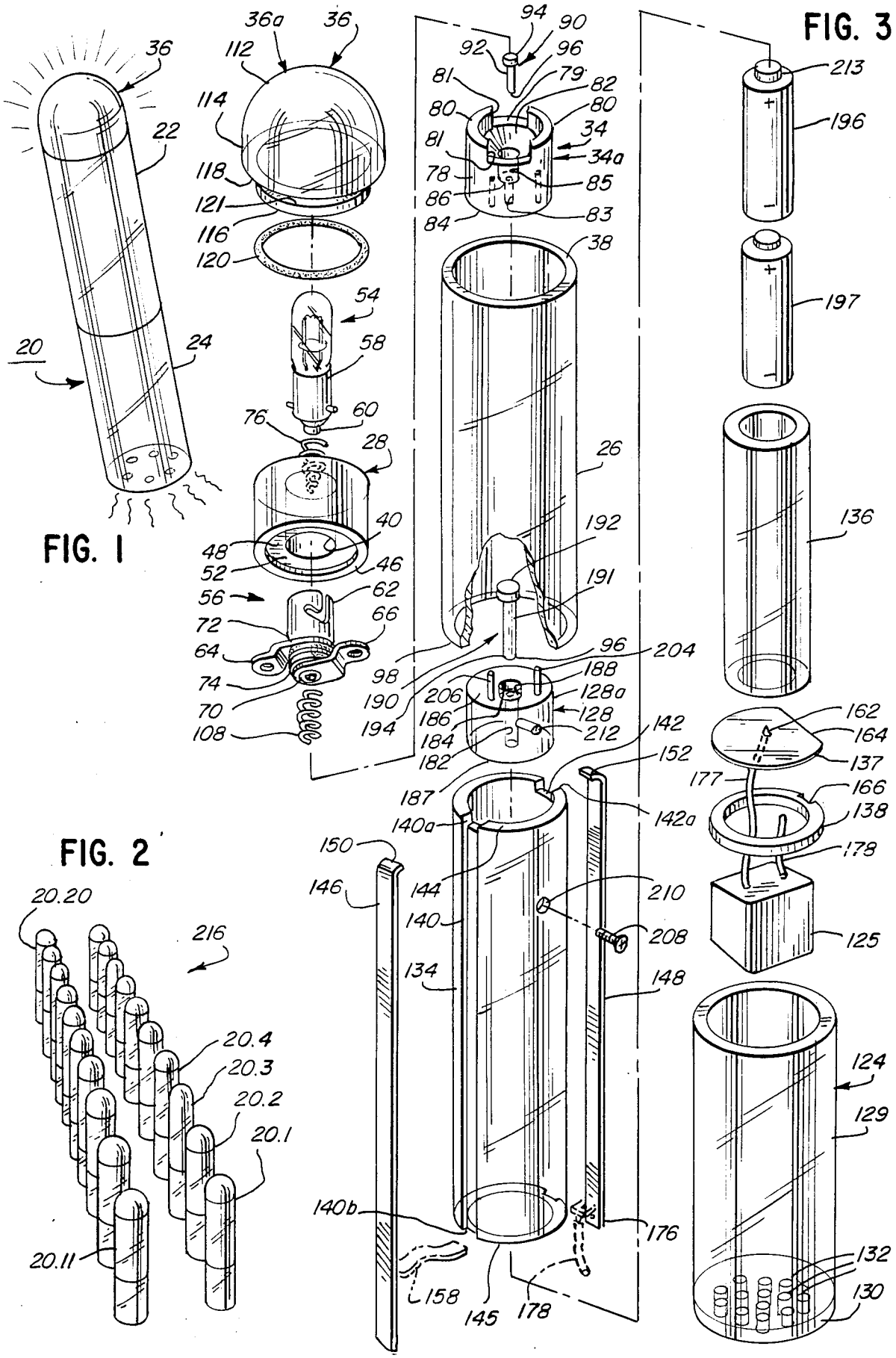
FIG. 1 is a perspective view of a game article of the invention with two companion playing pieces thereof assembled, so as to actuate signal means included in the article.
FIG. 2 is a perspective view of a representative set of individual game articles in accordance with the invention.
FIG. 3 is an enlarged exploded perspective view of the article of FIG. 1.

Referring to the drawings, particularly FIG. 1, a game article 20 constructed in accordance with the invention includes an assemby of two handheld companion playing pieces, a generally cylindrical tubular female playing piece 22 and, telescopically received therein, a generally cylindrical tubular male playing piece 24.

Referring to FIGS. 3, 4, and 6, the female playing piece 22 includes an open-ended cylindrical tubular shell 26, a support member 28 within the shell, a light source assembly 30 carried in the support member, a female interfit or mating unit 34 within the shell and to the rear of the light source assembly, and a cap unit 36 on the front end 38 of the shell. The shell 26, the support member 28, a body **34*a* of the female interfit unit 34, and a body 36*a* of the cap unit 36 preferably are made of plastic material such as polystyrene, either clear or colored. The body 36*a* of the cap unit 36 preferably is transparent or translucent, to permit visual observation of light emitted by the light source assembly 30** when it is energized.

The support member 28 is constructed as a substantially cylindrical block, having a diameter slightly less than the internal diameter of the shell 26. The support member 28 is carried within the shell 26 at a location slightly to the rear of its front end 38, and is fixedly secured to the inner wall surface of the shell, as by solvent-cementing or with adhesives. A cylindrical bore 40 extends centrally and longitudinally through the support member 28. A rearwardly facing annular flange 46 is provided on the rear end surface 48 of the support member 28. A rearwardly facing shoulder 52 is formed by the intersection of the flange 46 and the rear end surface 48.

The light source assembly includes a miniature bayonet-type incandescent light bulb 54 and a socket 56 for such a bulb. Electrical connection to the filament of the bulb 54 is made by contact of electrical conductors with a metal base 58 and a base button 60 of the bulb.

The socket 56 includes a metallic cylindrical bulb receptacle proper 62, a front terminal 64, and a rear terminal 66. The terminals extend radially outwardly from the rearwardly disposed end of the receptacle proper, at an angle of substantially 180 degrees to each other.

Referring to FIGS. 3 and 4, the front terminal 64 is in electrical contact with the receptacle proper 62, and, in consequence, with the base 58 of a bulb 54 seated in the socket 56. The rear terminal 66 is in electrical contact with a metallic tubular conductor 7 that extends centrally and longitudinally through the rear end portion 72 of the receptacle proper 62. The rear terminal 66 and the conductor 70 are insulated from the receptacle proper 62 and the front terminal 64 by an insulator 74. A metallic coil compression socket spring 76 (FIG. 4) is seated in the receptacle proper 62 within the conductor 70, and projects from the conductor to bear upon the base button 60 (FIG. 3) of a bulb 54 seated in the receptacle proper 62. The spring 76 provides springloading for a seated bulb and, with the conductor 70, completes an electrically conductive path from the rear terminal 66 to the base button 60.

As seen in FIG. 4, the socket 56 is adapted to be carried in the support member 28 with the receptacle proper 62 snugly received in the bore 40 of the support member, and the terminals 64 and 66 of the socket adjacent to the rear surface of the annular flange 46 of the support member 28.

Referring especially to FIG. 3, the interfit unit 34 of the female piece 22 includes a generally cylindrical base 78 and, extending forwardly from the front end surface 79 thereof, two integral arcuate flanges 80. The peripheral or outer wall surfaces of the flanges 80 and the base 78 are coaxial and continuous. The flanges 80 are spaced apart at their side edges, to define two diametrically opposed notches 81 between them and extending rearwardly to the front end surface 79 of the base 78.

A funnel-shaped countersink or recess 82 is provided in the front end surface 79 of the interfit unit base 78. A cylindrical counterbore 85, coaxial with the base 78, extends longitudinally in the base from the countersink 82. A cylindrical bore 83, of lesser diameter than the counterbore 85 and likewise coaxial with the base 78, extends longitudinally in the body from the counterbore to the rear end surface 84 of the base. A forwardly facing shoulder 86 is formed at the intersection of the counterbore 85 and the bore 83. Two cylindrical recesses or blind bores 87 and 88 (FIG. 6) are spaced radially from the longitudinal axis of the base 78 and extend longitudinally inwardly from the rear end surface 84 of the base.

A metallic contact pin 90 has an elongate cylindrical shank 92 and a short cylindrical head 94 of enlarged diameter at its front end. The pin 90 is carried in the base 78 of the interfit unit 34, with its shank 92 slidably received in the bore 83 and its head 94 received in the counterbore 85 and seated on the shoulder 86, which serves as a stop, preventing the pin 90 from being pushed rearwardly through the bore 83. A metalic coil compression biasing spring 108 is carried in the counterbore 85 and is seated on the pin head 94. The length of the pin shank 92 is selected to allow the rear end 96 thereof to protrude beyond the rear end surface 84 of the base 78 when the pin head 94 abuts on the shoulder 86 (see FIG. 4).

Referring to FIG. 4, after insertion of the socket 56 into the bore 40 of the support member 28, the female interfit unit 34 is inserted in the shell 26. With the spring 108 in the counterbore 85, the front end surfaces of the flanges 80 of the interfit unit 34 are fixedly secured, as by solvent-cementing or adhesive bonding, to the rear end surface 48 (FIG. 3) of the support member 28. Opposite ends of the spring 108 bear against the rear terminal 66 of the socket 56, and the head 94 of the pin 90, respectively. The spring 108 provides an electrically conductive path from the pin 90 to the terminal 66 and serves also resiliently to bias the pin 90 rearwardly. The two notches 81 in the interfit unit 34 accommodate the terminals 64 and 66 of the socket 56. As best seen in FIG. 4, electrical contact portions 104 and 106 of respective terminals 64 and 66 extend radially outwardly beyond the peripheral surfaces of the interfit unit 34.

The interfit unit 34 is spaced forwardly or inwardly from the rear end 98 of the rear end portion 99 of the shell 26, and thus is mounted in a recessed position in a receess 100 in the end portion. As a consequence, the interfit unit 34 is partially obscured from the view of a game player observing the female piece 22 separate from the male piece 24. Preferably, the unit 34 is further obscured by constructing the shell 26 of colored or opaque material.

Referring to FIG. 3, the body 36*a* of the cap unit 36 includes a rounded, dome-shaped front end portion 112 merging into a generally cylindrical tubular sleeve portion 114. A rearwardly extending circular flange portion 116 of reduced diameter is provided on the rear end of the sleeve portion 114. A shoulder 118 is formed at the intersection of the flange portion 116 and the sleeve portion 114. A resilient "O"-ring 120 is retained in a groove 121 in the flange portion 116 therearound.

The outer diameters of the sleeve portion 114 of the cap unit 36 and the shell 26 are substantially equal. The outer diameter of the flange portion 116 is slightly less than the inner diameter of the shell 26. The cap unit 36 is removably fitted into the front end 38 of the shell 26 by sliding the flange 116 telescopically thereinto. The "O"-ring 120 provides frictional resistance to movement on the inner wall surface of the shell 26, sufficient to secure the cap unit against accidental dislodgement from the shell while permitting removal of the cap when it is necessary to replace a bulb 54 in the socket 56.

Referring to FIGS. 3, 5, and 7, the male playing piece 24 includes a tubular base member or shell 124 having one end closed, a sound emitter in the form of a 3-volt buzzer 125 within the base member, a battery-holder group 126 mounted in the base member adjacent to the buzzer, and a male interfit or mating unit 128 within the holder group. The base member 124 and structural elements of the holder group 126 and the male interfit unit 128 preferably are made of plastic material such as poystyrene, either clear or colored.

The base member 124 preferably includes a cylindrical plastic tube 129 having external and internal diameters substantially equal to the respective external and internal diameters of the shell 26 of the female playing piece 22. The base member 124 also includes a transversely extending, circular disc-like plastic bottom plate 130 fixedly secured to the rear end of the tube 129 by suitable means, such as solvent-cementing, adhesive bonding, and ultrasonic welding. Perforations or bores 132 are provided in the bottom plate 130 and extend longitudinally therethrough.

The battery-holder group 126 includes an external casing 134, an internal battery housing 136, a conductive base element 137, and a non-conductive base element 138. A rear portion of the group 126 is telescopically received in the base member 124, with the nonconductive base element 138 spaced from the front wall surface of the bottom plate 130. The bottom plate 130, the non-conductive base element 138, and a rear end portion of the tube 129 form a compartment 139 housing the buzzer 125. The perforations 132 in the bottom plate permit the buzzer to be heard when it is actuated.

The casing 134 is a cylindrical tube having an outer diameter approximatey the same as, but slightly smaller than, the inner diameter of the tube 129 of the base member 124, thus permitting the casing 134 to be snugly telescopically inserted into the tube. The inner diameter of the casing 134 is greater than the diameter of the female interfit unit 34 of the female playing piece 22, thereby to allow telescopic reception of the unit within the casing 134, as described hereinafter. The casing 134 is secured to the tube 129 by solvent-cementing or other appropriate means.

Two diametrically-opposed, longitudinally-extending rectangular grooves 140 and 142 are formed in the outer wall surface of the casing 134. The grooves 140 and 142 extend between opposite ends of the casing, and terminate at respective notches **140*a* and 142*a* at the front end 144 of the casing. One groove 140 terminates in a notch 140*b* in the rear end 145** of the casing.

First and second flat strip, metallic electrical conductors 146 and 148, respectively, are carried in respective grooves 140 and 142 and are substantially flush with the external wall surface of the casing 134. Front end contact portions 150 and 152 of the conductors 146 and 148, respectively, are bent over the wall of the casing 134, in the front end notches **140*a* and 142*a*, to provide electrical contacts. A rear end portion 158 of the first conductor 146 is bent to pass radially inwardly of the wall of the casing 134, through the notch 140*b* provided in the rear end thereof. The rear end portion 158** is bent to form a generally V-shaped electrical contact extending diametrically across the casing.

The battery housing 136 is a cylindrical tube having an outer diameter approximately the same as, but slightly smaller than, the inner diameter of the casing 134. The inner diameter of the housing 136 in the illustrative embodiment is slightly larger than the outer diameter of a conventional "N" size battery. The length of the housing 136 in such embodiment is about twice the length of an "N" battery, but less than the length of the casing 134.

As best seen in FIG. 5, the battery-holder group 126 is assembled with the battery housing 136 encased within the casing 134, with the rearmost ends of the housing and the casing in closely spaced adjacent relation. The housing is fixedly secured to the casing, as by solvent-cementing. Alternatively, the casing 134 and the housing 136 may be formed in an integral one-piece unit.

The rear end of the battery-holder group 126 is formed by the conductive base element 137 and the non-conductive base element 138. The conductive base element 137 is a truncated circular metal disc having a central opening 162 therein and a linear shoulder 164 defined by a chord of the circle. The non-conductive base element 138 is a circular plastic ring having a generally rectangular notch 166 formed in its outer periphery. The outer diameters of the conductive and non-conductive elements are substantially equal to the outer diameter of the casing 134.

The conductive base element 137 is sandwiched between the rear edge of the casing 134 and the non-conductive base element 138. The assembly is secured by fixing the non-conductive base element 138 to the inner wall surface of the base member tube 129, by solvent-cementing or other suitable means.

The conductive base element 137 is disposed so that its shoulder faces the groove 142 in the casing 134, but is spaced therefrom, so as to provide clearance between the element and the conductor 148 in the groove. The non-conductive base element 138 is disposed with its notch 166 in registry with the groove 142, for receiving the second conductor 148 in the notch. A rear end portion 176 of the second conductor 148 is bent inwardly to abut the rear end surface of the non-conductive element 138.

Referring to FIGS. 3 and 5, the V-shaped end portion 158 of the first conductor 146 is soldered to the front surface of the conductive base element 137. A first electrical lead 177 from the buzzer 125 passes through the opening 162 in the conductive base element 137 and is soldered to the element. A second electrical lead 78 from the buzzer 125 is soldered to the bent rear end portion 176 of the second conductor 148.

Front and rear "N"-size batteries 196 and 197, respectively, are arranged in end-to-end series relation in the battery housing 136, to provide a 3-volt source of electrical power. The negative terminal of the rear battery 197, constituting the bottom or base thereof, is in electrical contact with the V-shaped portion 158 of the first conductor 146.

Referring to FIGS. 3, 5 and 7, a body **128*a* of the male interfit unit 128 is constructed as a substantially cylindrical block having a diameter dimensioned to permit the unit to be snugly and removably received in the casing 134. A cylindrical bore 182 extends axially through the body 128*a*. A counterbore 184 of larger diameter than the bore 182 and coaxial therewith extends inwardly from the front surface 186 of the body 128*a*. A forwardly facing shoulder 188 is defined by the intersection of the bore 182 and counterbore 184**.

A metallic contact pin 190 component of the male interfit unit 128 includes an elongate cylindrical shank 191 having an enlarged cylindrical head 192 at the front end thereof. The shank 191 is received in the bore 182 of the unit body **128*a*, and the head 192 is received in the counterbore 184 and seats upon the shoulder 188. A rear end portion 194 of the shank 191 protrudes slightly from the rear surface 187 of the unit body 128*a***, to provide an electrical contact, and is upset or thickened slightly to secure the pin in the unit.

Two cylindrical bores 198 and 200 spaced radially from the longitudinal axis of the body **128*a* of the male interfit unit 128 extend longitudinally thereinto from the front surface 186 thereof. Two interfit pegs 204 and 206 have rear portions thereof force-fitted into the bores 198 and 200, respectively. The front portions of the pegs 204 and 206 are normal to the surface 186** and project forwardly therefrom.

The disposition of the bores 198 and 200 in the body **128*a* of the male interfit unit 128, and thus also the disposition of the pegs 204 and 206, is like the disposition of the bores 87 and 88, respectively, in the body 34*a* of the female interfit unit 34. The pegs 204 and 206** in the male interfit unit 128 are freely received in the bores 87 and 88 in the female interfit unit 34, whereby the male and female units are mated, when the playing pieces 22 and 24 are assembled, as described hereinafter.

Referring to FIGS. 3 and 5, the male interfit unit body 128*a* serves as a front retainer for the batteries 196 and 197, and is removable to permit replacement thereof. The male interfit unit 128 is removably secured within the casing 134 by a screw 208 passing through a bore 210 extending radially through the wall of the casing 134, and into threaded engagement with a radially extending internally threaded bore 212 in the body 128*a* of the interfit unit.

The male interfit unit 128 is spaced rearwardly or inwardly from the front end 144 of the front end portion 147 of the casing 134 and thus is carried in a recessed position in a recess 149 in the end portion. As a result, the male interfit unit 128 is partially obscured from the view of a game player observing the male playing piece 24 separate from the female playing piece 22. Preferably, the view is further obscured by constructing the casing 134 of colored or opaque material.

The forwardly disposed positive terminal 213 of the front battery 196 is in electrical contact with the rear end portion 194 of the contact pin 190 in the male interfit unit 128, and is resiliently urged thereagainst by the spring action of the V-shaped portion 158 of the first conductor 146, bearing upon the bottom of the rear battery 197.

The front and portion 147 of the casing 134 of the male playing piece 24, adjacent to the free front end 144 thereof, is received within the female playing piece 22 in telescopic relationship. This is accomplished by inserting the front end portion 147 into the recess 100 in the rear end portion 99 of the shell 26 of the female piece 22, adjacent to the free rear end 98 thereof. The pegs 204 and 206 of the male interfit unit 128 of the male piece 24 are brought into register with the corresponding bores 87 and 88 of the female interfit unit 34 of the female piece 22, by rotation, as necessary, of the playing pieces 22 and 24 relative to one another. Movement of the male piece 24 forwardly relative to the female piece 22 then effects initial insertion of the pegs 204 and 206 into the corresponding bore 204 and 206, for mating the interfit units 34 and 128.

In the initially inserted condition, the rear end portion 96 of the contact pin 90 of the female interfit unit 34 contacts the head 192 of the contact pin 190 of the male interfit unit 128. The biasing spring 108 then provides a bias urging the playing pieces 22 and 24 apart. In the initial position, the front end contact portions 150 and 152 of the conductors 146 and 148 in the male playing piece 22 are in alignment with, but spaced slightly away from, the contact portions 104 and 106, respectively, of the terminals 64 and 66 in the female playing piece 22.

Further forward movement of the male playing piece 24 relative to the female playing piece 22 overcomes the biasing force of the spring 108 and brings the interfit units 34 and 128 into their final mating condition. In this condition, and also in the initial condition, the female interfit unit 34 of the female piece 22 is telescopically received within the casing 134 of the male piece 24. Consequently, the mating of the interfit units 34 and 128 takes place with both of the units disposed within both the shell 26 of the female playing piece 22 and the casing 134 of the male playing piece 24.

In the final mating condition of the playing pieces 22 and 24, the front end contact portions 150 and 152 of the respective conductors 146 and 148 of the male piece 24 are in electrical contact with respective aligned or opposed contact portions 104 and 106 of the female piece 22, and, also, the head 192 of the male piece contact pin 190 is in electrical contact with the rear end portion 96 of the female piece contact pin 90. The three electrical contacts made in this manner serve to complete electrical circuits containing the bulb 54 and the buzzer 125, whereby the bulb and the buzzer are energized and actuated to emit, respectively, light and sound, as signals that the playing pieces 22 and 24 have been mated.

The electrical circuitry of the game article 20 is illustrated schematically in FIG. 9, wherein the circuit elements lying above the broken line are components of the female playing piece 22, and the elements lying below the line are components of the male playing piece 24. Referring first to the circuit including the buzzer 125, the circuit is completed by simultaneously (1) bringing into contact the contact portion 106 of the rear terminal 66 of the bulb socket 56, and the front end contact portion 152 of the second conductor 148, and (2) bringing the head 192 of the male piece contact pin 190 into contact with the rear end portion 96 of the female piece contact pin 90. Current flow is from the positive terminal 213 of the front battery 196, through the contact pin 190 of the male interfit unit 128, the contact pin 90 of the female interfit unit 34, the biasing spring 108, the rear terminal 66, the second conductor 148, the second lead 178 from the buzzer 125, the buzzer, the first lead 77 from the buzzer, the conductive base element 137, the V-shaped contract portion 158 of the conductor 146, and the negative terminal of the rear battery 197.

Referring to the circuit including the bulb 54, the circuit is completed by simultaneously (1) bringing the contact portion 104 of the front terminal 64 of the bulb socket 56 into contact with the front end contact portion 150 of the first conductor 146, and (2) bringing the head 192 of the male piece contact pin 190 into contact with the rear end portion 96 of the female piece contact pin 90. Current flows from the positive terminal 213 of the forward battery 196, through the contact pin 190 of the male interfit unit 128, the contact pin 90 of the female interfit unit 34, the biasing spring 108, the conductor 70 in the receptacle 62 (see also FIG. 3), the socket spring 76, the base button 60 of the bulb 54, the filament of the bulb to the base 58 thereof, the bulb receptacle proper 62, the front terminal 64, the first conductor 146, the V-shaped contact portion 158, and the negative terminal of the rear battery 197.

Referring to FIG. 2, a pairing game is played with a game set 216 comprising a plurality or multiplicity of individual or discrete game articles 20. The illustrated set includes twenty such articles individually identified as numbers 20.1 through 20.20.

The female and male interfit units 34 and 128, respectively, of each of the playing pieces 22 and 24 of each game article 20.1–20.20 in the set 216 are so constructed and arranged as to mate or interfit with each other, so as to form the game article, but not with the playing pieces of some or all of the remaining articles in the set. Thus, if the articles 20.1 and 20.2 are not identical, when the male playing piece 24 of the article 20.1 is telescopically inserted into the female playing piece 22 of the article 20.2, both of the interfit pegs 204 and 206 of the male interfit unit 128 of the article 20.1 will not simultaneously be registrable with both of the recesses 87 and 88 of the female interfit unit 34 of the article 20.2, and the interfit units will not mate. The absence of mating is evidenced by the inability to actuate the buzzer 125 of the male piece 24 of the article 20.1 and the bulb 54 of the female piece 22 of the article 20.2.

Pairs of male and female interfit units which mate with each other but not with other units may conveniently be manufactured employing a drilling jig or template such as the jig 220 illustrated in FIG. 8. The jig 220 is circular and has a diameter on the order of magnitude of the diameters of the interfit units 34 and 128. A multiplicity of drill guide holes 22 is provided in the jig. The centers of the holes 222 are spaced apart equal distances and are located on a spiral curve 224 having its origin at the axis of the jig and ending adjacent to the periphery thereof.

In preparing a mating pair of units 34 and 128 for a game article 20, the axes of a unit to be prepared and the jig 216 are aligned, and a pair of guide holes 222 is selected and the holes are used as guides for drilling bores 87 and 88 in the female interfit unit of the pair, and the corresponding bores 198 and 200 in the male interfit unit of the pair. Interfit pegs 204 and 206 then are secured in the respective male unit bores 198 and 200. For each game article in the set 216, a different pair of guide holes 222 may be used to locate the bores in the interfit units of the article. Alternatively, if desired, a group or groups of identical articles 20 may be prepared by using the same set of guide holes 222 for the articles in each group.

Referring to FIGS. 10 and 11, another embodiment of the invention employs a female interfit unit 226 and a male interfit unit 228. The units 226 and 228 are substantially identical with the hereinabove described units, 34 and 128, respectively, with the exception that the projecting interfit pegs 204 and 206 of the male unit 128 are replaced by a projection 230 configured in some arbitrary shape, while a recess 232, complementary to the projection 230, is provided in the female interfit unit 226.

Playing articles 20.1 et seq. of the set 216 may be used in a game of pairing individuals, to promote mingling and social interaction among them. Employing half as many articles as there are game players, the individual articles are separated into their playing pieces 22 and 24, and the pieces are randomly distributed to the players, one piece to each player. Each player then tries to find the player holding the playing piece that matches his or her playing piece by a trial-and-error method of putting male and female pieces together, to determine whether they mate with each other.

Visual identification of matching playing pieces is hampered or rendered difficult by the recessed positioning of the female and male interfit units 34 and 128 within their respective playing pieces 22 and 24, and, preferably also, by coloring and/or opacifying appropriate portions of one or both playing pieces, as described above. Therefore, in order to determine whether they have matching playing pieces, the holders of a male and a female playing piece are impelled to physically telescope their respective pieces together, and then rotate one with respect to the other. If the pegs 204 and 206 encounter a complementary pair of bores 87 and 88, the pegs will enter the bores, and the electrical circuits described above will be closed. The achievement of the match is signaled by the emission of light from the bulb 54 and sound from the buzzer of the resulting assembled playing article 20.

The game may be played by any number of players, who are impelled to mingle, testing playing pieces held by others, until a matching piece is found. The number of contacts made between different individuals generally increases with the number of players. The playing pieces are hand-held, light in weight and compact, so that the players are not confined to one location in the playing area. but can move about freely, thereby promoting socialization, while seeking a matching playing piece. The game may be played at virtually any convenient place.

If desired a set 216 may include two or more identical articles 20, or may include two or more groups of identical articles 20, with the articles 20 of one group differing from those of other groups. Likewise, variations of the above-described game, and other games may be devised and played with the game set 216 and variations thereof.

While preferred embodiments of the invention have been illustrated and described, and reference has been made to certain changes and modifications which may be made in the embodiments, it will be apparent to those skilled in the art that further changes and modifications may be made therein within the spirit and scope of the invention. It is intended that all such changes and modifications be included within the scope of the appended claims.

I claim:

1. A game set comprising: a plurality of individual game articles each comprising two companion playing pieces, each piece including mating means for mating with mating means on its companion piece, thereby to form the article, the mating means of the pieces of each article being non-matable with the mating means of the pieces of other articles in the set, and the pieces of each article being separable from each other, for playing a game of seeking to mate the mating means of one piece with the mating means of a companion piece, a first playing piece of each of said articles having an end portion provided with a recess therein adjacent to a free end thereof, the mating means of said first playing piece being disposed within said recess and inwardly spaced apart from said free end to obscure the view of the mating means, and an end portion of a second playing piece of each of said articles being telescopically received within said end portion of the first playing piece in said recess thereof for mating the mating means of said playing pieces within said end portion of the first playing piece.

2. A game set as defined in claim 1 wherein the mating means of said playing pieces of each article are matable only in a limited number of angular dispositions of the pieces relative to each other, and the playing pieces of each article are rotatable with respect to each other when in said telescopic relationship of said end portions for orienting their mating means in dispositions enabling them to be mated.

3. A game set as defined in claim 1 wherein each article further includes signal means, and means for actuating said signal means upon mating the mating means of one playing piece with the mating means of a companion piece, thereby to signal the happening of such mating.

4. A game as defined in claim 3 wherein said signal means includes a light source and a sound emitter.

5. A game set as defined in claim 3 wherein said signal means is electrically actuatable, and further including dry cell battery means, and electrical circuit-forming means included in each of the playing pieces, said circuit-forming means being adapted for together completing an electrical circuit between said signal means and said battery means when said mating means of said playing pieces mate with each other, thereby actuating said signal means.

6. A game set as defined in claim 5 wherein said circuit-forming means in each playing piece includes electrical contact means arranged for contact with the contact means of the other piece to complete said circuit, and contact between the contact means on respective pieces is made within one of said pieces.

7. A game set as defined in claim 1 wherein, said articles are of the same size.

8. A game set which comprises a plurality of individual game articles, each article comprising:

two hand-held companion playing pieces telescopically received one within the other and separable from each other for playing a game with the separated pieces, each of said playing pieces having an end portion provided with a recess therein adjacent to a free end thereof, said end portion of one of said playing pieces being telescopically received within said end portion of the other playing piece in said recess thereof to provide said telescopic relationship of the playing pieces, each of said playing pieces including mating means for mating with mating means on the other playing piece, said mating means of each playing piece being disposed within the recess in said end portion of the piece and inwardly spaced apart from said free end of the end portion to obscure the view of the mating means of the piece, said mating means of said playing pieces being constructed and arranged for mating with each other when the playing pieces are in said telescopic relationship, thereby to form the article, said mating means of the playing pieces of each article being non-matable with the mating means of the playing pieces of other articles in the set for playing a game the objective of which is for a game player holding one piece to find by a trial-and-error process of matching pieces a companion piece among pieces that are distributed among other game players and include both matable and non-matable mating means in respective pieces.

9. A game set as defined in claim 8 wherein the mating means of said playing pieces of each article are matable only in a limited number of angular dispositions of the pieces relative to each other, and the playing pieces of each article are rotatable with respect to each other when in said telescopic relationship for orienting their mating means in dispositions enabling them to be mated.

* * * * *